US006240685B1

(12) United States Patent
Eichhorn

(10) Patent No.: US 6,240,685 B1
(45) Date of Patent: Jun. 5, 2001

(54) SIMULATED MULTI-PANE GLASS PANEL

(75) Inventor: Keith L. Eichhorn, High Point, NC (US)

(73) Assignee: Glass Unlimited of High Point, Inc.

( * ) Notice: Subject to any disclaimer, the term of this patent is extended or adjusted under 35 U.S.C. 154(b) by 0 days.

(21) Appl. No.: 09/459,440

(22) Filed: Dec. 13, 1999

(51) Int. Cl.[7] ..... F06B 3/68

(52) U.S. Cl. ..... 52/204.61; 52/311.2; 52/456; 52/314

(58) Field of Search ..... 52/204.591, 204.593, 52/204.61, 456, 311.1, 311.2, 311.3, 316, 455, 314, 656.1, 656.5, 656.9, 204.6, 786.13, 786.1

(56) References Cited

U.S. PATENT DOCUMENTS

| | | | | |
|---|---|---|---|---|
| 3,411,258 | | 11/1968 | Kessler . | |
| 4,145,858 | | 3/1979 | Dovman . | |
| 4,437,284 | | 3/1984 | Cribben et al. . | |
| 4,488,919 | | 12/1984 | Butler . | |
| 4,813,990 | | 3/1989 | Thorn . | |
| 4,970,840 | | 11/1990 | Ouellette et al. . | |
| 5,018,330 | * | 5/1991 | Lewkowitz | 52/455 |
| 5,086,596 | * | 2/1992 | Schlyper | 52/204.591 |
| 5,487,245 | | 1/1996 | Dazo et al. . | |
| 5,555,654 | * | 9/1996 | Hermann | 40/714 |
| 5,840,391 | | 11/1998 | Eichhorn et al. . | |
| 5,853,835 | | 12/1998 | Leniton . | |
| 5,853,852 | | 12/1998 | Eichhorn . | |
| 5,983,593 | * | 11/1999 | Carbary | 52/786.11 |

* cited by examiner

*Primary Examiner*—Beth A. Stephan
(74) *Attorney, Agent, or Firm*—Rhodes & Mason, P.L.L.C.

(57) ABSTRACT

A decorative building unit simulating a multi-pane, window or door. The decorative building unit is comprised of a glass support frame and a single glass panel having an outer surface mounted on or in the glass support frame. The glass panel has at least one simulated joint comprising at least two shallow spaced apart parallel grooves formed in the outer surface of the glass panel and a platform formed between the two spaced grooves. The size and spacing of glass support frame simulated muntins and platforms is such that, when mounted together, the simulated muntins and platforms align with each other to simulate a multi-pane beveled glass window or door.

38 Claims, 4 Drawing Sheets

SIMULATED MULTI-PANE GLASS PANEL

FIELD OF THE INVENTION

The present invention is directed to a decorative building unit of the type used for architectural applications, and, more particularly, to a decorative building unit simulating a multi-pane beveled glass window or door.

BACKGROUND OF THE INVENTION

In recent years, the interior and exterior design of buildings and structures, as well as the furnishings therefor, have employed increasing quantities of decorative glass. For example, it is now commonplace for glass sheets to be used in various types of doors such as shower doors, storm doors, patio doors, entry doors, bi-fold doors, and in decorative windows, mirrors, and other furniture and architectural applications. As the scope of architectural and design tastes expands, the industry has become increasingly receptive to glass sheet products which have unique visual effects. Accordingly, cost effective methods for constructing glass sheet products are being sought.

Kessler (U.S. Pat. No. 3,411,258) discloses a plastic false muntin system for giving a large single glass panel the appearance of a window or door with smaller panels. Special caps attach to the window or door frame and plastic grill pieces snap into place about these caps. Cribben et al. (U.S. Pat. No. 4,437,284) discloses a false muntin assembly for converting a single window pane into one having multiple panels by using muntin bars which snap onto metal clips that are affixed to the window panel. Likewise, Ouellette et al. (U.S. Pat. No. 4,970,840) discloses a window and grill which uses hidden clips to fasten a grill assembly on top of a single large pane of glass. Dazo et al. (U.S. Pat. No. 5,487,245) discloses a window or door construction on which muntins are attached on either side of a unitary piece of glass by way of small, spaced apart holes cut through the glass.

One particularly popular glass sheet design, which does not use a false muntin system, simulates traditional brass camed doors and windows. Grooves are formed in the glass surface in a pattern corresponding to a desired caming pattern and simulated caming is laid into the grooves so that the caming is inset in the glass (see, for example, U.S. Pat. No. 4,488,919 to Butler).

There is also known a convenient and cost-effective means and method for effectively simulating beveled glass panes in a decorative glass sheet to give the appearance of a traditional camed glass window or door. See U.S. Pat. No. 5,840,391 to Eichhorn et al. Eichhorn discloses a method for forming a plurality of grooves in a glass panel, including forming a pair of opposed, parallel, spaced apart grooves, the pair of spaced apart grooves relatively positioned such that the respective peripheral walls are disposed adjacent one another and define a platform extending between the grooves. At least one caming strip is adhered to the platform adjacent, between and along the peripheral edges of the spaced apart grooves.

Eichhorn also discloses that the decorative, simulative effect is enhanced when certain parameters are observed. A first wall width is preferably no greater than 15percent of a second wall width. Preferably, each second wall forms an angle with the outer surface of the glass panel of at least 2 degrees. Each first wall should form an angle with the outer surface of the glass panel of at least 45 degrees. Preferably, each groove has an overall width of from about 5 to 30 millimeters, and more preferably of 10 to 20 millimeters.

The depth of each groove should not exceed 30 percent of the thickness of the glass panel. The glass sheet thickness is preferably from about 3 to 6 millimeters.

The disclosure in Eichhorn, U.S. Pat. No. 5,840,391, is hereby incorporated by reference in its entirety. However, Eichhorn is directed to a technique in which caming strips are adhered to a platform formed by adjacent parallel grooves to simulate a camed door or window. The strips must be aligned and affixed by glue or tape. This operation can become tedious.

SUMMARY OF THE INVENTION

The present invention, on the other hand, utilizes a different type of frame which greatly facilitates the manufacture of a simulated beveled French door or window. In this approach, a support frame is provided with frame members (hereinafter referred to as "simulated muntins") extending between opposed side members and between opposed end members to form a grid. A glass panel is provided with simulated beveled joints. Each simulated beveled joint includes parallel spaced apart shallow grooves formed in the outer surface of the glass panel and a platform formed between the two spaced grooves. The size and spacing of simulated muntins and simulated joints is such that the muntins and platforms align with each other when the glass panel is mounted on or in the glass support frame. When assembled, the assembly looks like a paned window or French door frame with separate beveled glass panes.

In a preferred embodiment, the support frame includes a rectangular support frame having a pair of opposed spaced apart side walls and a pair of opposed spaced apart end walls. Each side and end wall has an L-shaped cross section which forms a recessed region for receiving a single glass panel. A plurality of simulated muntins extend between and are attached to the pair of side walls and a plurality of simulated muntins are attached to the pair of end walls. The simulated muntins may be attached to the support frame by nailing, tacking, gluing, screwing, or any other suitable attachment means. Alternatively, the simulated muntins may be formed as an integral part of the support frame. The support frame, once assembled with the desired number of simulated muntins, is prepared for receiving the glass panel. The glass panel corresponds in size and shape to the recessed region of the glass support frame such that it can be mounted in the recessed region with ease. The glass panel thickness is preferably between about 3 and about 6 millimeters. Alternatively, the support frame may be flat on the rear (without an L-shaped cross-section). In such a case, the glass panel is merely attached to the rear surface of the frame by appropriate hardware.

Desirably, the glass panel will have beveled regions extending between the side edges of the glass panel, beveled regions extending between the end edges of the glass panel, and beveled regions adjacent to the side edges and end edges. These beveled regions simulate joints in a traditional beveled window or door construction. The number and arrangement of beveled regions corresponds directly to the number and arrangement of simulated muntins. Each beveled region, except the beveled regions adjacent to the side and end edges, includes at least two shallow spaced parallel grooves that are formed in the outer surface of the glass panel and a platform between the two spaced grooves. The platform may be either the original outer surface of the glass panel, or if less height is desired, a flat region between the two spaced grooves formed in the outer surface. The beveled regions adjacent to the side and end edges may comprise a single shallow groove. Desirably, the depth of each groove should not exceed 30 percent of the thickness of the glass panel. The total width of each groove is preferably about 10 to about 20 millimeters. Each groove will have two wall surfaces. A first wall extends from a first peripheral edge to a groove apex bottom and a second wall extends from the apex bottom to a second peripheral edge. The second wall has a width greater than the width of the first wall. Preferably, each second wall forms an angle with the outer surface of the glass panel of at least 2 degrees. Each first wall should form an angle with the outer surface of at least 45 degrees.

The size and spacing of the support frame simulated muntins and the platforms is such that the simulated muntins and the platforms align with each other when the glass panel is mounted in the recessed region of the support frame. Latches, clips, or other suitable fasteners or holders secure the glass panel in the recessed region. While it is not necessary that the support frame be in contact with the glass sheet, there is a need to limit the distance between the simulated muntins and the glass sheet as much as possible, so that a user will be unable to observe that the window or door is not a true multi-pane construction. In this manner, the assembled building unit simulates a multi-pane beveled glass window or door. Depending upon the specific application, it may be desirable to place a spacer material between the platforms and simulated muntins to prevent vibration and noise. Again, the spacer material should be invisible to the user such that the appearance of a true beveled multi-pane window or door is maintained.

Another aspect of the present invention includes a support frame provided with simulated muntins extending between opposed side members and between opposed end members, a first glass panel provided with simulated joints having an outer surface mounted in the support frame, a second glass panel provided with simulated joints having an outer surface mounted in the support frame with an inner surface mounted adjacent to the inner surface of the first glass panel, and an inner grid formed of simulated muntins which fits adjacent to the second glass panel and is a mirror image of the simulated muntins adjacent to the first glass panel.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

Figure 1:
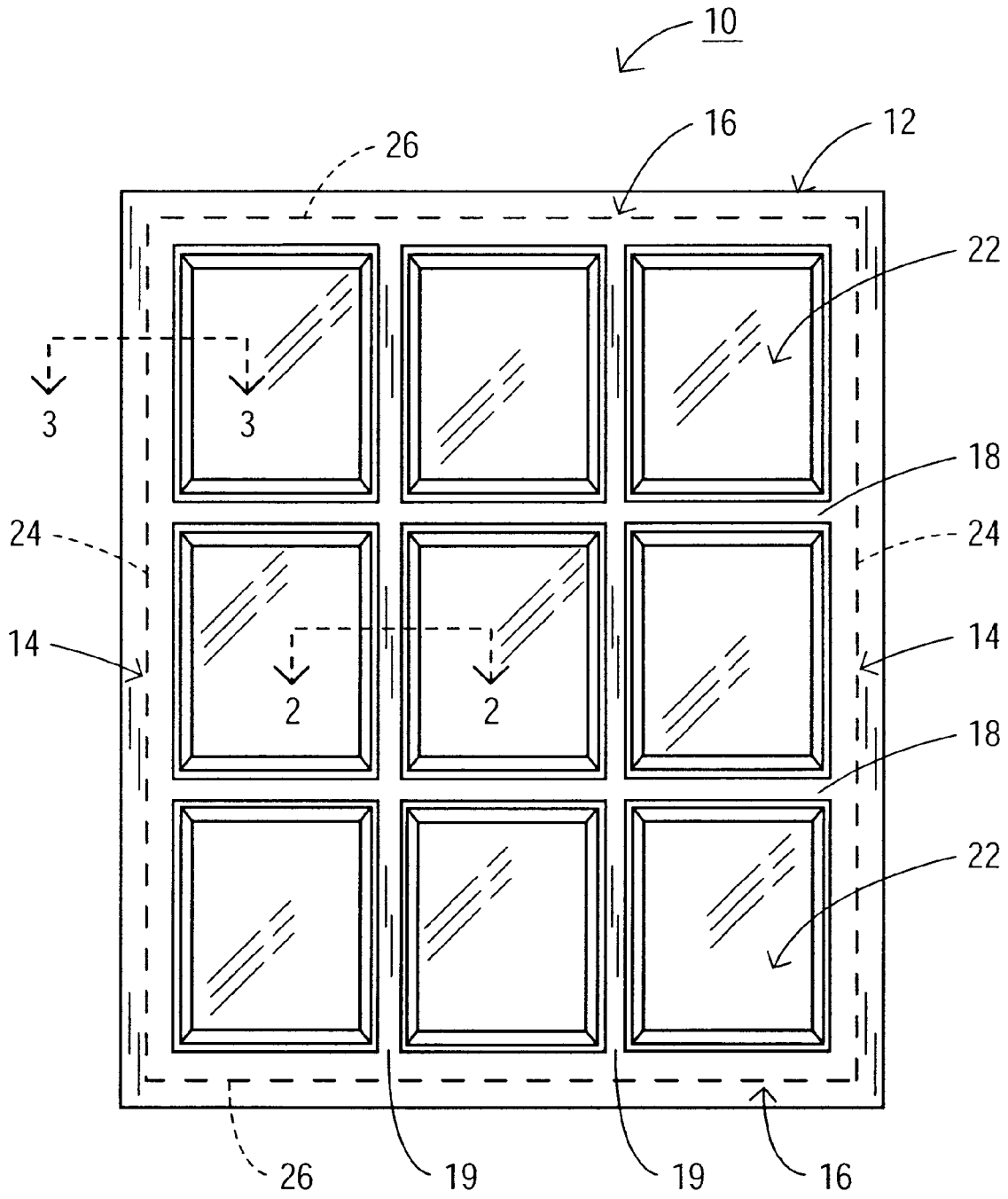
FIG. 1 is a front plan view of a decorative building unit simulating a multi-pane window according to the present invention.
Figure 2:
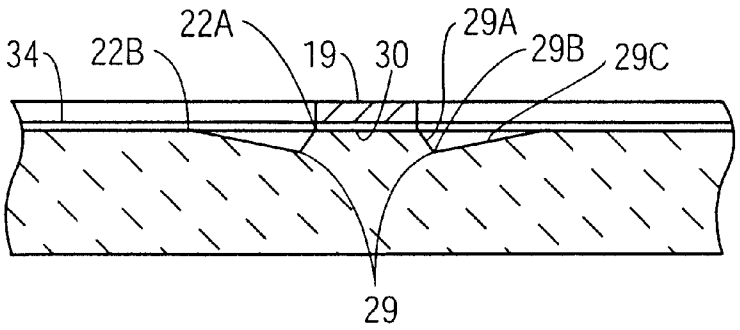
FIG. 2 is a schematic, fragmentary cross sectional view of the decorative building unit taken along the line 2—2 of FIG. 1.
Figure 3:
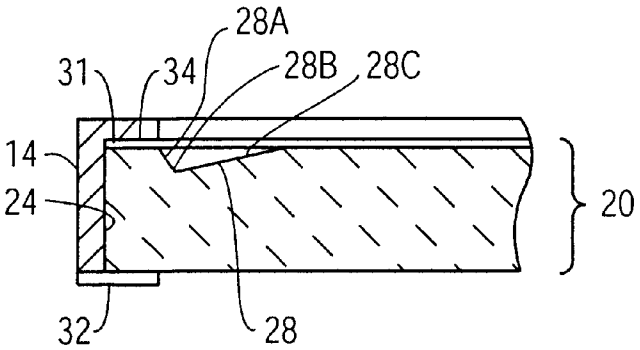
FIG. 3 is a schematic, fragmentary, cross sectional view of the decorative building unit taken along the line 3—3 of FIG. 1.

As seen in FIG. 1, the preferred embodiment of the present invention provides a decorative building unit 10 which includes a support frame 12 and a glass panel 22. The support frame 12 is rectangular and is formed by a pair of opposed, spaced apart L-shaped side walls 14 and a pair of opposed, spaced apart L-shaped end walls 16. Referring to FIGS. 1 through 3, L-shaped side walls 14 and end walls 16 form a recessed region 20 for receiving the glass panel 22. Simulated muntins 18 extend between and are suitably attached to the side walls 14 and simulated muntins 19 extend between and are suitably attached to the end walls 16. When the side walls 14, end walls 16, and simulated muntins 18 and 19 are attached together, the glass support frame 12 is completely assembled and ready to receive a glass panel 22 in recessed region 20.

The frame may be wooden or metal, and the simulated muntins may be wooden, metal or plastic. The simulated muntins are preferably pre-assembled as a grid and attached to the frame. The simulated muntins may be attached to the frame by nailing, gluing, tacking, screwing, or any other suitable attachment means.

Referring again to FIG. 1, glass panel 22 has a pair of spaced apart side edges 24 and a pair of spaced apart end edges 26. The glass panel 22 has a shape that corresponds to the shape of the recessed region 20. As seen in FIGS. 2 and 3, in order to simulate a multi-pane glass window or door, glass panel 22 further includes beveled regions extending between the side edges 24 and end edges 26. These beveled regions may comprise a single shallow groove 28, particularly where adjacent a top or end. Alternatively, and preferably for the central area, the beveled regions comprise two shallow, spaced apart grooves 29. Each groove 28, 29 includes a first wall 28A, 29A extending from a first peripheral edge 22A of glass panel 22 to a groove bottom apex 28B, 29B, and a second wall 28C, 29C extending from groove bottom apex 28B 29B to a second peripheral edge 22B. As previously stated, the grooves are shallow with the long wall 28C, 29C being formed at an angle of at least 2° (and preferably from about 6 to 10°) with the surface of the glass, and the short wall 28A,29A being formed at an angle of 45 to 68° with the surface. Greater angles for the short wall would be preferable, but the glass tends to chip if too great an angle is attempted with conventional grinding wheels. Also, the depth of grooves 28, 29 should not exceed 30% of the thickness of the glass. The parallel grooves 29 define at least one platform 30 therebetween. The single shallow grooves 28 define a platform 31 between the grooves 28 and the end and side edges 24, 26 of glass panel 22. Once the selected number of beveled regions 28, 29 have been formed in glass panel 22, glass panel 22 is ready to be received in glass support frame 12.

As seen in FIGS. 2 and 3, the size and spacing of end and side walls 14, 16, simulated muntins 18, 19, grooves 28, 29, and platforms 30 is designed such that when glass panel 22 is placed in recessed region 20 of glass support frame 12, the simulated muntins 18 and 19 and platforms 30 will align with each other to simulate a multi-paned beveled window or door. That is, the size and shape of the platforms 30 defined by the beveled regions 28, 29 substantially matches the size and shape of the simulated muntins 18 and 19.

As seen in FIG. 3, securing hardware 32 is located around the rear peripheral edges of side walls 14 and end walls 16 to hold glass panel 22 securely in place. Any suitable securing means 32 well known in the art may be used for holding glass panel 22 in place. Depending up the specific application envisioned for the decorative building unit, it may be desirable to place spacer members 34 between glass panel 22, end and side walls 14, 16, and simulated muntins 18, 19 to eliminate any potential rattle due to small movements between the glass panel 22 and the glass support frame 12. Any desirable and suitable spacer member material such as rubber or foam may be used. The spacer material may be held in place by being adhered either to the frame or to the glass panel. In either case, the spacer member should be sized and shaped so as to be invisible to the user.

Figure 4:
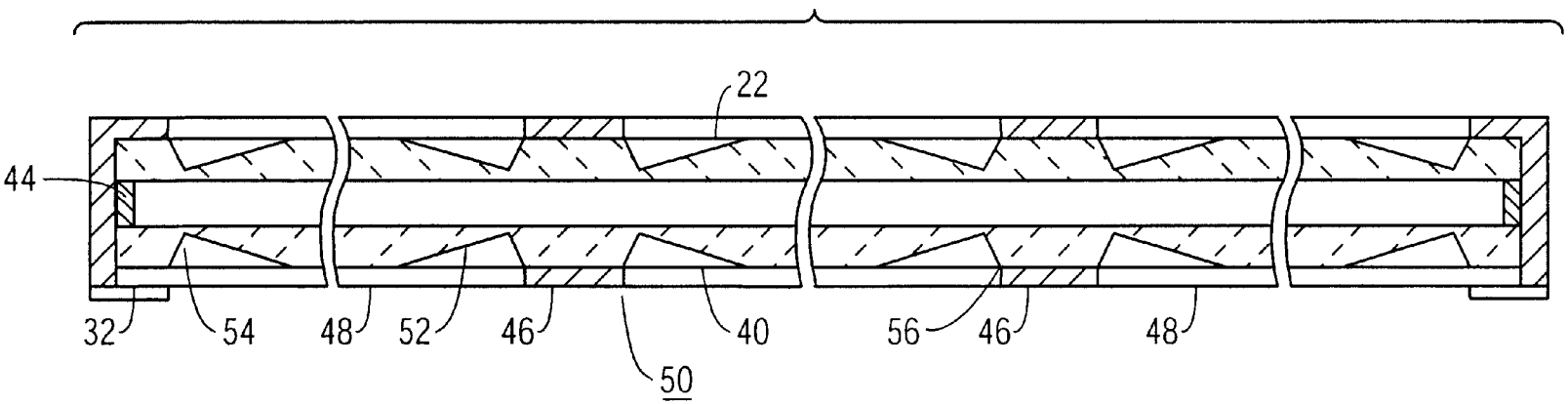
FIG. 4 is a schematic, fragmentary, cross sectional view of the decorative building unit illustrating the use of two glass panels.
Figure 5:
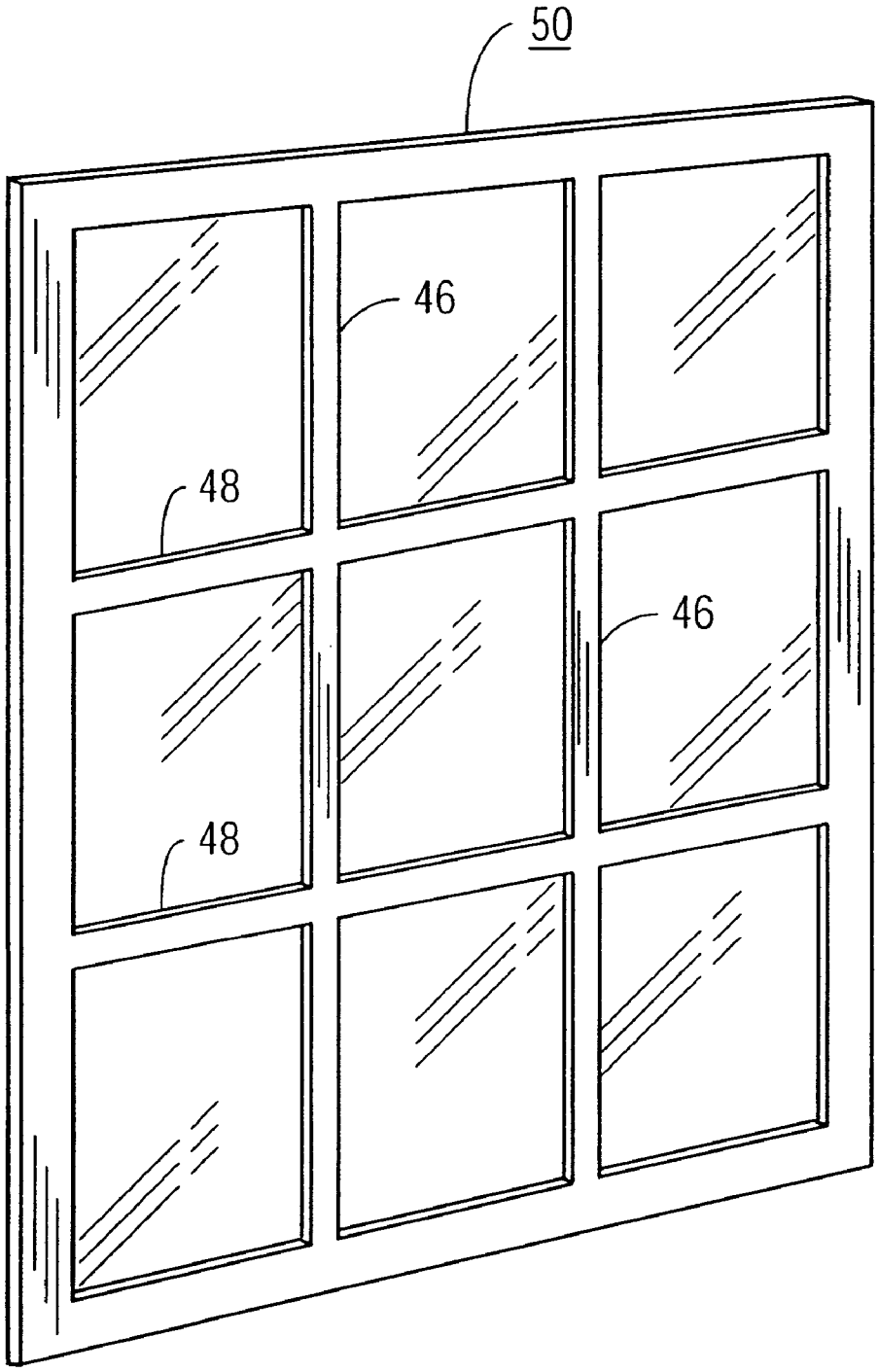
FIG. 5 is a front plan view of a grid mounted on a decorative building unit adjacent a second glass panel.

Depending upon the desired application, such as an entry door, it may be desirable to install a second glass panel 40 such that the assembled building unit simulates a multi-pane beveled door when viewed from either the outside or inside. As seen in FIG. 4, a second glass panel 40 is mounted in glass support frame 12 such that it is laterally spaced apart from glass panel 22. A suitable spacer member 44 such as rubber, foam, wood, or plastic may be used to separate glass panels 22 and 40 and to eliminate potential rattle between glass panels 22 and 40. The spacer member 44 should be sized and shaped so as to be invisible to the user and such that glass panels 22, 40 simulate a single glass panel beveled on both sides. Grooves 52, 54 and platforms 56 formed in glass panel 40 are identical grooves 28, 29 and platforms 30 formed in glass panel 22 such that the two glass panels 22, 40 mirror each other. As seen in FIGS. 4 and 5, a grid assembly having simulated muntins 46, 48 is positioned adjacent glass panel 40 to assist in holding glass panel 40 in support frame 12. Simulated muntins 46, 48 and platforms 56 align with each other to simulate a multi-pane beveled window or door when viewed from the second glass panel 40 side. Again, any suitable securing means 32 may be used to hold both panels 22, 40 and grid 50 in place in support frame 12.

Figure 6:
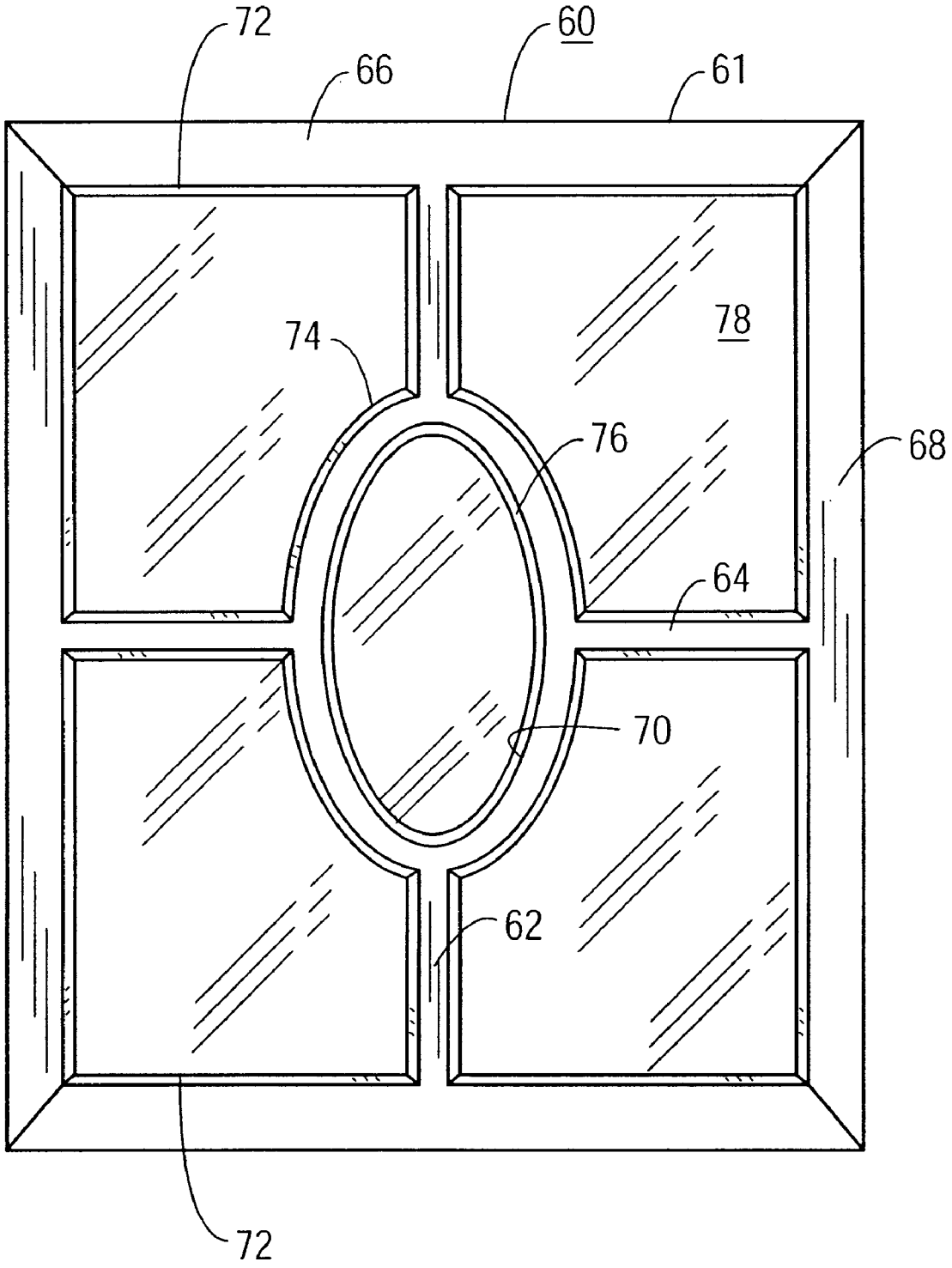
FIG. 6 is a front plan view of a decorative building unit illustrating an alternative decorative design simulating a multi-pane window according to the present invention.

The shape of simulated muntins 18, 19, 46, and 48 need not be limited to straight, parallel sections. Other designs may also be used in which beveled regions 20 are formed in glass panel 22 to enhance the architectural and aesthetic features of the building unit. One such building unit 60 is shown in FIG. 6. A glass support frame 61 includes a peripheral support frame. Straight simulated muntins 62, 64 extend between and are attached to the side walls 68 and end walls 66. An oval frame member 70 is attached to simulated muntins 62, 64. Beveled regions 72, 74, and 76 are formed in glass panel 78. Glass panel 78 is then mounted in glass support frame 61.

As will be apparent, the present invention provides a convenient and cost-effective way in which to provide a building unit that simulates a much more expensive multi-pane beveled window or door. Since the glass support frame and beveled glass panel may be made separately and subsequently assembled together, the present invention permits the manufacture of components to be performed at different locations and by different suppliers. Further, the design permits a simple, quick final assembly of components, without the need for using adhesives or other bonding materials which often require significant curing times.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A decorative building unit simulating a multi-pane beveled glass window or door, comprising:

a) a glass support frame comprising:

a peripheral support frame having a pair of opposed spaced apart side walls and a pair of opposed spaced apart end walls, each side and end wall having an L-shaped cross-section;

at least one simulated muntin extending between and attached to said pair of side walls and at least one simulated muntin extending between and attached to said pair of end walls;

said L-shaped side and end walls forming a recessed region for receiving a glass panel;

b) a first glass panel having an outer surface mounted in said recessed region, said first glass panel having a pair of spaced apart side edges and a pair of spaced apart end edges and corresponding in size and shape to said recessed region of said frame;

at least one simulated joint formed in said outer surface and extending between said side edges of said first glass panel, and at least one simulated joint formed in said outer surface and extending between said end edges of said first glass panel;

each of said simulated joints comprising:

i) at least two shallow spaced apart parallel grooves formed in said outer surface;

ii) a platform defined between said two spaced grooves;

beveled regions formed in said outer surface of said first glass panel extending along each said side edge and each said end edge;

each said beveled region comprising:

i) a single shallow groove formed in said outer surface;

ii) a platform defined between said groove and said edge of said glass panel;

c) wherein the size and spacing of said simulated muntins and said grooves and platforms of said simulated joints are such that, when said first glass panel is received in said recessed region, said simulated muntins align with said platforms of said simulated joints to simulate the appearance of a multi-pane beveled glass window or door; and d) a means for securing said first glass panel in said frame.

2. The decorative building unit of claim 1 wherein each of said grooves formed in said outer surface of said glass panel includes a first wall extending from a first peripheral edge to a groove bottom apex and a second wall extending from said apex to a second peripheral edge, said second wall having a width greater than a width of said first wall.

3. The decorative building unit of claim 2 wherein said groove first wall width is no greater than about 15 percent of said second wall width.

4. The decorative building unit of claim 2 wherein each said groove second wall forms an angle with said outer surface of said glass panel of at least 2degrees.

5. The decorative building unit of claim 2 wherein each said groove first wall forms an angle with said outer surface of said glass panel of at least 45 degrees.

6. The decorative building unit of claim 1 wherein each said glass panel groove has an overall width of from about 5 to about 30 millimeters.

7. The decorative building unit of claim 6 wherein each said glass panel groove has an overall width of from about 10 to about 20 millimeters.

8. The decorative building unit of claim 1 wherein said glass panel has a thickness of from about 3 to about 6 millimeters.

9. The decorative building unit of claim 8 wherein the depth of each said glass panel groove does not exceed 30 percent of the thickness of said glass panel.

10. The decorative building unit of claim 1 wherein at least one spacer member is disposed between said glass support frame and said glass panel.

11. The decorative building unit of claim 3 further including a second glass panel unit, comprising:

a) a second glass panel having an outer surface mounted in said frame recessed region and laterally spaced apart from said first glass panel, said second glass panel having a pair of spaced apart side edges and a pair of spaced apart end edges and corresponding in size and shape to said recessed region of said frame;

at least one simulated joint formed in said second glass panel outer surface and extending between said side edges of said second glass panel and at least one simulated joint formed in said second glass panel outer surface and extending between said end edges of said second glass panel, said simulated joints corresponding in size, shape, and position to said simulated joints of said first glass panel;

each of said simulated joints comprising:

i) at least two shallow spaced apart parallel grooves formed in said outer surface;

ii) a platform defined between said two spaced grooves; beveled regions formed in said outer surface of said second glass panel extending along each said side edge and each said end edge;

each said beveled region comprising:

i) a single shallow groove formed in said outer surface;

ii) a platform defined between said groove and each said side and end edge of said glass panel;

b) a grid comprising:

i) a pair of opposed spaced apart side walls and a pair of opposed spaced apart end walls;

ii) at least one simulated muntin extending between and attached to said pair of side walls and at least one simulated muntin extending between and attached to said pair of end walls; wherein said grid corresponds in size and shape to said recessed region of said frame;

c) wherein the size and spacing of said muntins and said grooves and platforms is such that, when said second glass panel is received in said recessed region, said simulated muntins of said grid align with said platforms; and d) a means for securing said second glass panel and said grid in said frame.

12. The decorative building unit of claim 11 wherein each said groove second wall forms an angle with said outer surface of said glass panel of at least 2 degrees.

13. The decorative building unit of claim 11 wherein each said groove first wall forms an angle with said outer surface of said glass panel of at least 45 degrees.

14. A decorative building unit simulating a multi-pane beveled glass window or door, comprising:

a) a glass support frame comprising:

a peripheral support frame having a pair of opposed spaced apart side walls and a pair of opposed spaced apart end walls;

at least one simulated muntin extending between and attached to said pair of side walls and at least one simulated muntin extending between and attached to said pair of end walls;

b) a single glass panel having an outer surface mounted on said frame, said glass panel having a pair of spaced apart side edges and a pair of spaced apart end edges;

at least one simulated joint extending between said side edges and at least one simulated joint extending between said en d edges;

each of said simulated joints comprising:

i) at least two shallow spaced parallel grooves formed in said outer surface;

ii) a platform defined between said two spaced grooves;

beveled regions formed in said outer surface of said first glass panel extending along each said side edge and each said end edge;

each said beveled region comprising:

i) a single shallow groove formed in said outer surface;

ii) a platform defined between said groove and said edge of said glass panel;

c) wherein the size and spacing of said simulated muntins and said grooves and platforms of said simulated joints are such that, when said glass panel is mounted against said glass support frame, said simulated muntins and said platforms of said simulated joints align with each other to simulate said multi-pane beveled glass window or door; and d) a means for securing said glass panel on said frame.

15. The decorative building unit of claim 14 wherein each side and end wall of said peripheral support frame have an L-shaped cross section.

16. The decorative building unit of claim 15 wherein said L-shaped side and end walls form a recessed region for receiving a glass panel.

17. The decorative building unit of claim 16 wherein said glass panel has an outer surface mounted in said frame recessed region.

18. The decorative building unit of claim 14 wherein each of said grooves formed in said outer surface of said glass panel includes a first wall extending from a first peripheral edge to a groove bottom apex and a second wall extending from said apex to a second peripheral edge, said second wall having a width greater than a width of said first wall.

19. The decorative building unit of claim 18 wherein said groove first wall width is no greater than 15 percent of said second wall width.

20. The decorative building unit of claim 18 wherein each said groove second wall forms an angle with said outer surface of said glass panel of at least 2degrees.

21. The decorative building unit of claim 18 wherein each said groove first wall forms an angle with said outer surface of said glass panel of at least 45degrees.

22. The decorative building unit of claim 14 wherein each said glass panel groove has an overall width of from about 5 to about 30 millimeters.

23. The decorative building unit of claim 22 wherein each said glass panel groove has an overall width of from about 10 to about 20 millimeters.

24. The decorative building unit of claim 14 wherein said glass panel has a thickness of from about 3 to about 6 millimeters.

25. The decorative building unit of claim 24 wherein the depth of said glass panel grooves does not exceed 30 percent of the thickness of said glass panel.

26. The decorative building unit of claim 14 wherein at least one spacer member is disposed between said glass support frame and said glass panel.

27. A decorative building unit simulating a multi-pane window or door, comprising:

a) a glass support frame comprising:

a peripheral support frame having a pair of opposed, spaced apart side walls and a pair of opposed, spaced apart end walls;

at least one simulated muntin extending between and attached to said pair of side walls and at least one simulated muntin extending between and attached to said pair of end walls;

b) a single glass panel having an outer surface mounted on said frame, said glass panel having a pair of spaced apart side edges and a pair of spaced apart end edges; at least one simulated joint comprising i) at least two shallow spaced apart grooves formed in said outer surface;

ii) a platform defined between said two spaced grooves c) wherein the size and spacing of said simulated muntins and said grooves and platforms of said simulated joints are such that, when said glass panel is secured against said glass support frame, said simulated muntins and said platforms of said simulated joints align with each other to simulate said multi-pane beveled glass window or door; and d) a means for securing said glass panel on said frame.

28. The decorative building unit of claim 27 wherein side walls and said end walls have an L-shaped cross section.

29. The decorative building unit of claim 28 wherein said L-shaped side walls and end walls form a recessed region and said glass panel is received in said recessed region.

30. The decorative building unit of claim 27 wherein each of said grooves formed in said outer surface of said glass panel includes a first wall extending from a first peripheral edge to a groove bottom apex and a second wall extending from said apex to a second peripheral edge, said second wall having a width greater than a width of said first wall.

31. The decorative building unit of claim 30 wherein said groove first wall width is no greater than 15 percent of said second wall width.

32. The decorative building unit of claim 30 wherein each said groove second wall forms an angle with said outer surface of said glass panel of at least 2 degrees.

33. The decorative building unit of claim 30 wherein each said groove first wall forms an angle with said outer surface of said glass panel of at least 45 degrees.

34. The decorative building unit of claim 27 wherein each said glass panel groove has an overall width of from about 5 to about 30 millimeters.

35. The decorative building unit of claim 34 wherein each said glass panel groove has an overall width of from about 10 to about 20 millimeters.

36. The decorative building unit of claim 27 wherein said glass panel has a thickness of from about 3 to about 6 millimeters.

37. The decorative building unit of claim 36 wherein the depth of said glass panel grooves does not exceed 30 percent of the thickness of said glass panel.

38. The decorative building unit of claim 27 wherein at least one spacer member is disposed between said glass support frame and said glass panel.

* * * * *